US006135888A

United States Patent [19]

Hindi

[11] Patent Number: 6,135,888

[45] Date of Patent: Oct. 24, 2000

[54] EXPANDABLE POLICE BATON WITH CONVENIENCE BULBOUS HANDLE

[76] Inventor: Robert C. Hindi, 8034 Innsdale Ct., Las Vegas, Nev. 89123

[21] Appl. No.: 09/173,135

[22] Filed: Oct. 15, 1998

[51] Int. Cl.[7] ..... F41B 15/02

[52] U.S. Cl. ..... 463/47.2; 463/47.7

[58] Field of Search ..... 463/47.2, 47.7

[56] References Cited

U.S. PATENT DOCUMENTS 83,228 10/1868 Warne ..... 463/47.7

1,165,216 12/1915 Weflen ..... 463/47.7

5,728,003 3/1998 Hustad ..... 463/47.7

*Primary Examiner*—William M. Pierce

*Attorney, Agent, or Firm*—Ice Miller Donadio & Ryan; Russell E. Fowler, II; Jay G. Taylor

[57] ABSTRACT

Expandable police batons are made readily retrievable and more easily usable by the addition of a bulbous end.

11 Claims, 1 Drawing Sheet

EXPANDABLE POLICE BATON WITH CONVENIENCE BULBOUS HANDLE

BACKGROUND OF THE INVENTION

1. Field of the Invention

This invention relates to police equipment, specifically, this invention relates to equipment police are authorized to use to quell violent suspects, and more specifically, this invention relates to batons, or other static extended reach police devices.

2. State of the Art

Police have used batons, truncheons, clubs and the like for millennia for non-lethal control of suspects and to provide a visible indiction of authority. Starting no later than the nineteenth century police used the "billy-club," a two or three foot long hard wood club with a handle and a wrist strap for the police officer's convenience that also provided non-slip control of the weapon. A safety hazard existed with this strap. The hand could get twisted and caught in combat. These were the standard police issued baton until the mid-nineteen seventies when they were replaced in many departments with the PR-24 style baton. The PR-24 (™ Monadnock Life Time Products, Inc., Fitzwilliam, N. H. 03447) style baton is a length of metal tubing about two feet or so long and 1.5 or so inches in diameter that has a short perpendicular handle mounted about two thirds of the distance from the front of the weapon to the end. The perpendicular handle provides better leverage and control of the baton in violent combat or arrest situations. More recently, these batons have been replaced by the straight expandable baton in many departments and in various divisions of other departments. Expandable batons are conveniently sized items that, when retracted, can be placed in a police officers utility belt and do not create any impediment to the officer in the further performance of his other duties, but are always conveniently located for instant use, if the occasion demands.

When the PR-24 style baton came into use, all the tubing, including the horizontal handle and the ends of the tubing were all the same diameter. This lead to some problems in that the baton, once dropped in low lighting conditions was more difficult to identify for a proper grip to retrieve and use. So the ball-ended horizontal handle was developed. This development has eluded the straight expandable baton.

The great perceived advantage of straight expandable batons is their small size and convenient storage. Therefore, designers have avoided the use of anything that enlarges the diameter of the baton anywhere along the length of its collapsed handle. This reluctance has not stopped all designers who would try to use the end of a expandable baton as a point of attachment for utilities on the baton. The primary example of such an approach is shown in U.S. Pat. No. 4,037,839 issued to Nelson, which shows the use of a round enlarged end ball of an expandable baton to house a retraction and extension button for the baton. In actual use, such a device would be inadvisable since the baton needs two hands to utilize it and may be grabbed by violent perpetrators or may violently hit a surface, the ground or the like, and collapse or expand at an inadvisable time thereby causing injury to either or both of the officer and suspect.

There are many expandable batons, the Nelson baton, the Monadnock baton, and the A.S.P. baton—which is generally similar to the PR-24 baton. All of these batons must be drawn before they can be used at all. Inclement weather presents a problem for rapid and secure drawing of the weapon. These inclement conditions are those frequently encountered by law enforcement personnel. These conditions make it imperative that the officer be able to rapidly draw the baton and the second most important thing an officer must do after drawing the baton is extend the baton, and secure the extended sections before use. In the case of the Nelson baton, extension of the baton requires two hands, one to hold the shaft and one to activate the button. In realistic combat situations, the officer does not have the luxury of using both hands to extend the weapon, while warding off a potential attacker. In this regard the Monadnock and A.S.P. batons are better, since they require only one hand to draw and extend.

After the weapon is drawn, it must be used. During a physical confrontation, an officer may have to use less force than provided by a full swing of an extended weapon. The officer will also have to de-escalate the confrontation as the suspect is subdued. It would be advantageous to have a second striking surface that was less lethal and impacted less heavily on the suspect than the full swing of the baton. Here the Nelson baton suffers since it has internal parts that could malfunction if the baton was hit too vigorously.

During combat the baton may be inadvertently dropped by the officer. If this happens, it may roll away from the officer and leave him without a suitable weapon. The Nelson baton will not roll since its ball end will force the baton to 'orbit'. However, both the Monadnock and A.S.P. weapons will roll, and may roll from the officer if they are dropped.

Another problem with conventional batons, is that they may be dropped by the officer during physical confrontation or pursuit. If this happens under poor illumination conditions, the officer must pick the weapon up using visual means or touch. The Monadnock and A.S.P. weapons do not allow the top or bottom ends of the baton to be readily determined by touch alone.

Even if the officer could find the dropped baton, in the case of the Monadnock or A.S.P. weapons, the officer would have some degree of difficulty grasping the baton with his fingers, since the baton would be laying flat on the surface.

Batons must be concealable during certain off-duty and plain clothes operations. Since a holster is usually visible even under clothes under some circumstances, an officer operating under these conditions may want to conceal the weapon in his waist band. However, the weapon must stay in his waist band and not slide downwardly under the influence of gravity. the Nelson baton provides a partial solution, but the rounded end may still allow the baton to wedge into his waist band and start to fall. Neither the Monadnock nor the A.S.P. weapon allow secure waist band holding, and they may slide downwardly almost at any time.

Officers must be able to rapidly acquire a weapon, in this case the expandable baton, that will provide them with as much safety as possible. the disadvantage of the Monadnock and A.S.P. systems is that without a bulb on the end of the weapon, the officers stiff fingers, caused by cold, or the officers moist and slippery fingers caused by warm conditions may allow the weapon to slip or otherwise be difficult to hold on to.

The weapon must be available for rapid deployment to the officers hand. The Nelson baton suffers from the shape of the bulb, it being round, and therefore more easily slipped from the officers hand. In the case of the Monadnock and A.S.P. batons, the batons have no raised end feature, and the baton may slip from the officers hand during deployment.

Therefore, there exists a need to have an expandable baton that has an enlarged end that will not affect the baton's function or its use, but will permit the baton to be readily recovered if dropped, will allow an officer to know instantly by feel alone in the darkest situation, or in a situation where the officer is rendered temporarily blinded by substances or the like, which end of the baton is the extended end, and will allow an officer to carry the baton around in its retracted state without undue excess burdens being placed on the officer's utility belt. Moreover, there is a need for a baton that will allow a more secure, less slip prone grip. so the deployed baton will not slip accidentally or as a result of force externally applied to it.

SUMMARY OF THE INVENTION

This invention enhances the functionality and safety of all expandable police batons and creates a more easily usable baton by the addition of this unique bulbous end.

In a first aspect of this invention, an expandable police baton comprises a hollow, substantially cylindrical handle member having a first end and a second end;

a telescoping portion slidably received inside the handle member having at least one substantially cylindrical nested member having a first end and a second end, the nested member located inside and coaxial with the handle member, the nested member tapered and having at the second end at least one portion of slightly larger diameter allowing the inner member to come into non-slidable, fixed position with the first end of the handle member; and a bulb end on said handle member.

In a second aspect of this invention, an expandable police baton comprises a hollow handle member defining the largest diameter section of a plurality of nested members;

at least two nested members slidably received in the handle member, a first substantially hollow member located inside and coaxial with the handle member, the first member having a first end and a second end, and tapered, the second end allowing the first nested member to come into non-slidable fixed position with respect to the handle member, and a second substantially solid member located inside and coaxial with the first member, the second member having a first end and a second end, and tapered, the second end allowing the second nested member to come into non-slidable fixed position with respect to the first member, the second member defining the smallest diameter section of the nested members; and a bulb end on said handle member having at least one circle breaking extension outwardly extending.

In a third aspect of this invention, a bulb attaches to the non-extending end of the outer member of a expandable baton comprising;

a hemispherical bulb at least 50% larger than the handle member of the baton.

DETAILED DESCRIPTION OF THE PREFERRED EMBODIMENT

Figure 1:
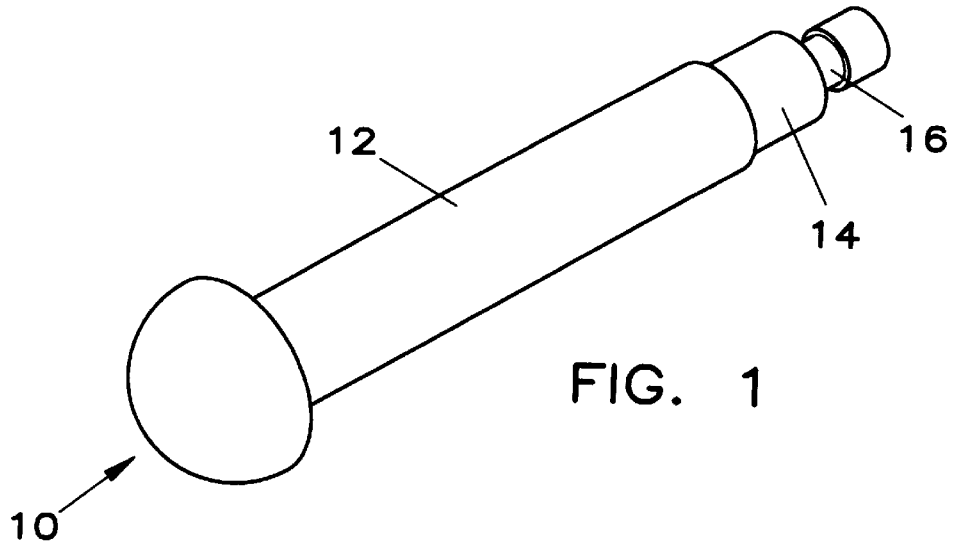
FIG. 1 shows a perspective view of the baton of this invention in a partially extended configuration.

Referring now to FIG. 1, a device 10, having several expandable and weighted extension members. The first, and outermost member 12 is a substantially cylindrical, and hollow handle member. It is preferably coated with a non-slip surface to prevent accidental slippage when the officer uses it in the field. One preferred coating is foam polyurethane. Inside the handle are the slidably mounted extension pieces. First, and in contact with the handle is the first contact piece 14. It is tapered slightly, and when extended, is held in place by mating the taper on the second end of the first extension piece, with the handle. Similarly, the second extension piece 16, located slidably within the first extension piece, has a slightly tapered mating surface on the handle at its second end. The second extension piece is a weighted piece, and is the contact end when fully extended. The bulb end 18 is mounted on the end of the baton.

Figure 2:
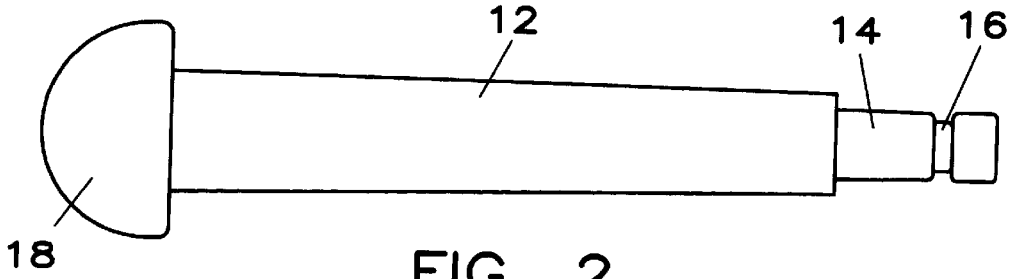
FIG. 2 shows a cut-away elevational view of the baton shown in FIG. 1.

Referring to FIG. 2, the handle member 12 encloses the extension members 14 and 16, which are slidably mounted within the handle member. The extension members are slightly tapered and when the second end of the first extension member contact the handle member, and the second end of the second extension member contact the first end of the first extension member, the baton is in a fixed and non-slidable configuration. The handle member of this invention is covered with a rubber covering that assists the overall grip of the baton when in use.

Figure 3:
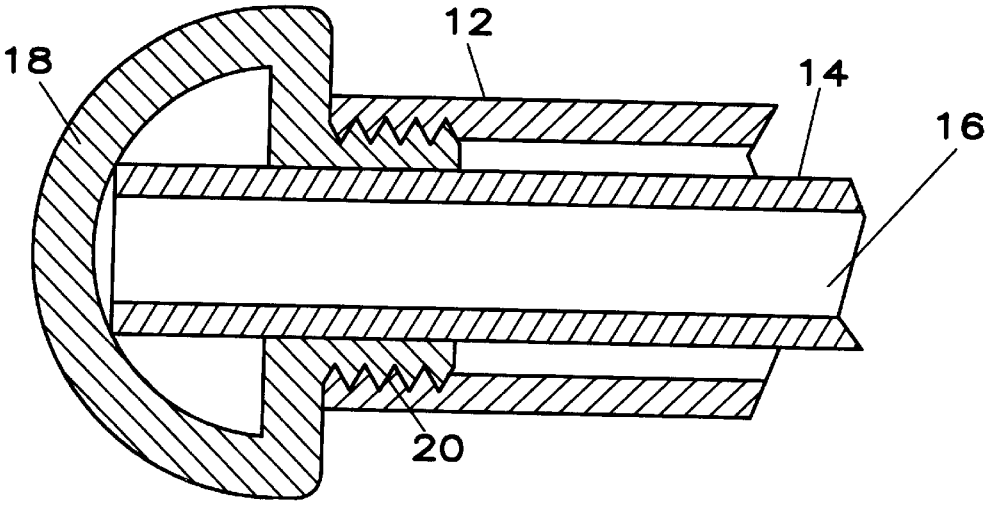
FIG. 3 shows an elevational cut-away view of a detail of the bulb end of the handle portion of the baton shown in FIG. 1.

Referring to FIG. 3, the bulb 18 of the invention is a hemispherical bulb made of metal, high impact plastic, wood, or similar material. Preferably, the bulb is hollow, and can receive the second ends of the extension pieces 14 and 16 when the baton is in retracted configuration. The diameter of the hemisphere of the bulb is at least fifty percent larger than the diameter of the handle member.

At the second end of the handle is a bulb 18. It is preferably made of hard plastic or the like, and is attached to the handle in a non-removable way. The bulb allows the user, the police officer to drop and quickly recover the baton. The bulb is attached to the second end of the handle buy threaded means, although any other conventional attachment means would work as well.

The bulb allows the second end of the handle to always be at least some distance off the ground, and allows the officer's fingers to conveniently slide under and retrieve the baton. The bulb also forces the baton to 'orbit' around the first end, whether expanded or not, if the baton is dropped in combat or similar serrations.

The bulb is attached to the handle by threaded means 20 or other conventional attachment means. In a preferred embodiment, the second end of the first extension piece and the second end of the second extension piece fit into the handle. In this way, first and second extension pieces larger than the handle can be used and not create a hazard or storage problem. The bulb may be attached to the handle in any of the well known conventional methods, for example, it can be welded, or otherwise permanently attached to the handle. The major feature of any useful attachment means of the present invention is that the bulb not be detached from the handle in violent combat and other law enforcement situations.

Although it is known to use handles similar to this to house any number of controls for the baton, extension, retrieval, flashlight and the like, in this invention, it is greatly preferred that the bulb be only a solid piece of plastic or metal. The reason is to prevent breakage of the baton under adverse conditions, such as combat, or night deployment. The solid bulb will not allow the baton to retract unexpectedly, or not to retract all all if it has been the subject of rough treatment in a fight or similar situation.

The baton of this invention provides a baton to be drawn out of holster in an easier, quicker manner; provides a baton use with a better overall non-slip and generally more secure grip and support during deployment; provides a baton user with a more powerful, accurate and controlled swing; provides the baton user with an additional striking tool which would decrease more serious injuries to suspects which would decrease liability of officers and departments; allows a baton that is accidently dropped in combat to remain in close proximity in a closed or expanded position; provides a baton user to easily identify visually or by touch, without a doubt a dropped baton in low lighting conditions or temporary blindness by substances; provides a baton user with an easier, quicker pickup from ground if dropped; provides a baton user with more options of concealability; provides a baton user to carry it around in a retracted state without undue excess burdens on the officers utility belt; this invention provides such benefits never before available.

The baton of the present invention allows easy and quick withdrawal for use from the baton holster in the users utility belt. The hemispherical shape of the bulb allows the user's fingers to slip over the bulb, and grasp the flat surface beneath the rounded portion of the bulb. This allows a secure and sure grasp of the baton while it is still in the user's holster, thereby allowing use in emergency and other situations where the user may not have the luxury of time to properly grab his baton. Moreover, the bulb can be used as a slip prevention device during less than ideal conditions when it is drawn.

The shape of the bulb also allows the officer to use it as an additional, less forceful sticking surface during combat. The rounded surface is larger and less force intensive than the extended striking surface, allowing the officer to use the minimum force a situation might demand.

The baton with the bulb of the invention will not roll away during combat situations. At worse, it will 'orbit', and the officer can readily find and retreive it for prompt redeployment. Since the bulb raises the handle of the weapon off the ground some what the officer will have little trouble in grasping it off the supporting surface. Moreover, the shape of the baton informs the officer which side is up by touch alone, and the baton when retrieved even in zero light conditions can be readily, promptly, and correctly redeployed.

The baton of the present invention is readily concealed. It can fit on the waist band and the flat surface of the hemispherical bulb will provide a positive non-sliding feature to assure that the weapon is positioned exactly where the officer thinks it will be at all times.

The functionality of the baton is completely unaffected by the addition of the hemispherical bulb. It does not interfere with the conventional use of the baton in any way. The user can still extend the extension members to full length by a flick of his wrist. In some other designs offered as conveniences for the user, the user may have to use both hands to extend the baton to its full length.

The bulb of the present invention also provides the officer with an additional weapon. The bulb of the non-expanded baton can be used as the baton is held in the officer's hand, and wielded as an adjunct to the officer's hand. The officer's hand is therefore slightly hardened against injury and can apply more force than the officer would normally have been able to by use of his hands alone. This provides the officer with an additional non-lethal tool for use in close in combat situations. The advantage of using the bulb end is that it provides a more controlled and less forceful application of striking force than the fully extended baton might.

This invention has been described by reference to specific examples and preferred embodiments. One with ordinary skill in the art can modify, alter, or change the preferred embodiment. The appended claims are intended to encompass all such modifications, alterations, and changes.

I claim:

1. An expandable police baton comprising:

a hollow, substantially cylindrical handle member having a first end and a second end;

a telescoping portion slidably received inside the handle member having at least one substantially cylindrical nested member having a first end and a second end, the nested member located inside and coaxial with the handle member, the nested member tapered and having at the second end at least one portion of slightly larger diameter allowing the inner member to come into non-slidable, fixed position with the first end of the handle member; and a bulb end on said handle member, the bulb end including a substantially flat surface and an essentially hemispherical portion, the essentially hemispherical portion having a smooth rounded surface free of projections and an edge defined along a spherical sector of the essentially hemispherical portion, the flat surface extending substantially perpendicular to the axis of the handle member at the second end of the handle member and facing the first end and extending substantially to the edge of the hemispherical portion so that a substantially sharp junction is formed between the flat surface and the essentially hemispherical portion.

2. The expandable baton of claim 1 wherein the nested member is solid.

3. The expandable baton of claim 1 wherein the telescoping portion inside the handle member includes at least two nested members.

4. The expandable baton of claim 1 wherein the nested members include a first substantially cylindrical hollow member located inside and coaxial with the handle member, the first member having a first end and a second end, and tapered, the second end allowing the first nested member to come into non-slidable fixed position with respect to the handle member, and a second substantially cylindrical solid member located inside and coaxial with the first member, the second member having a first end and a second end, and tapered, the second end allowing the second nested member to come into non-slidable fixed position with respect to the first member.

5. The expandable baton of claim 1 wherein the bulb is hollow.

6. The expandable baton of claim 5 wherein the hollow portion of the bulb provides a recess to accommodate extension pieces larger than the handle member.

7. The expandable baton of claim 1 wherein the bulb includes at least one molded portion to prevent rolling of the bulb on a substantially flat surface.

8. An expandable police baton comprising:

a hollow handle member defining the largest diameter section of a plurality of nested members;

at least two nested members slidably received in the handle member, a first substantially hollow member located inside and coaxial with the handle member, the first member having a first end and a second end, and tapered, the second end allowing the first nested member to come into non-slidable fixed position with respect to the handle member, and a second substantially solid member located inside and coaxial with the first member, the second member, the second member having a first end and a second end, and tapered, the second end allowing the second nested member to come into non-slidable fixed position with respect to the first member, the second member defining the smallest diameter section of the nested members; and a bulb end on said handle member including a flat surface and an essentially hemispherical portion having a circular edge, the essentially hemispherical portion having a smooth rounded surface free of projections, the flat surface extending radially from and essentially perpendicular to the handle member and facing the first end, the flat surface further extending substantially to the circular edge such that a substantially sharp junction is formed between the flat surface and the essentially hemispherical portion of the bulb.

9. The expandable baton of claim 8 wherein the bulb is hollow.

10. The expandable baton of claim 9 wherein the hollow portion of the bulb provides a recess to accommodate extension pieces larger than the handle member.

11. The expandable baton of claim 8 wherein the bulb includes at least one molded portion to prevent rolling of the bulb on a substantially flat surface.

* * * * *